US010499742B2

(12) United States Patent
Bock et al.

(10) Patent No.: US 10,499,742 B2
(45) Date of Patent: Dec. 10, 2019

(54) MECHANISM FOR A CHAIR

(71) Applicant: BOCK 1 GMBH & CO. KG, Postbauer-Heng (DE)

(72) Inventors: Hermann Bock, Pyrbaum (DE); Martin Ballendat, Braunau am Inn (AT)

(73) Assignee: BOCK 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 15/861,714

(22) Filed: Jan. 4, 2018

(65) Prior Publication Data

US 2018/0184809 A1 Jul. 5, 2018

(30) Foreign Application Priority Data

Jan. 4, 2017 (DE) ..... 10 2017 100 117
May 15, 2017 (DE) ..... 20 2017 102 909 U

(51) Int. Cl.
*A47C 1/035* (2006.01)
*A47C 1/022* (2006.01)
(Continued)

(52) U.S. Cl.
CPC ..... *A47C 1/035* (2013.01); *A47C 1/022* (2013.01); *A47C 1/03255* (2013.01);
(Continued)

(58) Field of Classification Search
CPC ..... A47C 1/035; A47C 1/022; A47C 1/03255; A47C 1/03261; A47C 1/03277; A47C 3/12
(Continued)

(56) References Cited

U.S. PATENT DOCUMENTS 4,684,173 A * 8/1987 Locher ..... A47C 1/03255 297/300.3
6,523,898 B1 * 2/2003 Ball ..... A47C 1/023 297/284.4
(Continued)

FOREIGN PATENT DOCUMENTS

DE 10106791 A1 8/2002
DE 202012012606 U1 6/2013
(Continued)

OTHER PUBLICATIONS

Machine Translation of EP 2520199 by Hansen. (Year: 2019).*

*Primary Examiner* — Mark R Wendell
(74) *Attorney, Agent, or Firm* — Laurence A. Greenberg; Werner H. Stemer; Ralph E. Locher

(57) ABSTRACT

A mechanism for a chair is particularly suited for an office chair. In order to improve the sitting comfort of a chair, the mechanism has a base support to be placed on a chair column, a seat support disposed on the base support and movable in the longitudinal direction of the chair relative to the base support, and a backrest support which is connected to the seat support. The seat support includes first and second seat support elements. The second seat support element is movable transversely with respect to the longitudinal direction of the chair relative to the first seat support element and/or the backrest support includes first and second backrest support elements. The second backrest support element is rotatable relative to the first backrest support element about a rotational axis which lies in the longitudinal direction of the chair.

11 Claims, 6 Drawing Sheets

(51) Int. Cl.
*A47C 1/032* (2006.01)
*A47C 3/12* (2006.01)

(52) U.S. Cl.
CPC ..... *A47C 1/03261* (2013.01); *A47C 1/03277* (2013.01); *A47C 3/12* (2013.01)

(58) Field of Classification Search
USPC ..... 297/302.1
See application file for complete search history.

(56) References Cited

U.S. PATENT DOCUMENTS

| | | | | |
|---|---|---|---|---|
| 9,713,380 | B2 | 7/2017 | Gehner et al. | |
| 2004/0075321 | A1* | 4/2004 | Sangiorgio | A47C 1/03255 297/300.1 |
| 2009/0212617 | A1* | 8/2009 | Krob | A47C 1/03233 297/316 |
| 2009/0261637 | A1* | 10/2009 | Schmitz | A47C 1/03255 297/217.2 |
| 2015/0164225 | A1* | 6/2015 | Bohmann | A47C 1/03255 297/313 |
| 2015/0245713 | A1 | 9/2015 | Desanta | |
| 2016/0100691 | A1* | 4/2016 | Masunaga | A47C 7/462 297/285 |

FOREIGN PATENT DOCUMENTS

| | | | |
|---|---|---|---|
| DE | 102012107778 | A1 | 6/2014 |
| DE | 202014101592 | U1 | 6/2014 |
| DE | 102014103780 | B3 | 6/2015 |

* cited by examiner

MECHANISM FOR A CHAIR

BACKGROUND OF THE INVENTION

Field of the Invention

The invention relates to a mechanism for a chair, in particular for an office chair. Over and above this, the invention relates to a chair with such a chair mechanism.

Among other things, synchronous mechanisms, asynchronous mechanisms and rocker mechanisms are known as mechanisms for office chairs.

The designation synchronous mechanism is to be understood, in this case, as assemblies in the seat substructure of an office chair which provide for coupled together kinematics which involve a certain relative movement of seat and backrest with respect to one another. The seat of the office chair, which is generally speaking provided with an upholstered sitting surface, is mounted on the seat support. The backrest support, which commonly extends to the rear from the actual synchronous mechanism, supports the backrest of the office chair on an upwardly extending arm. Seat support and backrest support are usually flexibly coupled in such a manner that a pivoting movement of the backrest to the rear—as can be produced, for example, by the chair user leaning back against the backrest—causes the rear edge of the seat to be lowered downward. As a result, the so-called "shirt riding up effect" is prevented and the seat comfort increased.

The designation asynchronous mechanism is to be understood as such assemblies where a pivoting of the backrest does not result in a movement of the seat support. In other words, a pivoting movement to the rear moves the backrest exclusively. Sitting comfort is reduced compared to synchronous mechanisms. In particular, the so-called "shirt riding up effect", can occur in the case of asynchronous mechanisms on account of a "diverging" of the movements of backrest and seat. However, such assemblies, on account of their comparatively simple design, are clearly more economical to produce than the previously described synchronous mechanisms.

Rocker mechanisms are comparatively simply designed assemblies in the seat substructure of chairs where the backrest support is connected more or less rigidly to the seat support, the seat or the frame of the chair. By means of the rocker mechanism, the seat support-backrest support combination created in this manner is pivotable to the rear about a pivot axis which extends transversely with respect to the longitudinal direction of the chair when the user of the chair leans back against the backrest. Such rocker mechanisms are often used in place of synchronous mechanisms in low-priced visitor or conference chairs in order to realize a simple rocking function here. On account of their comparatively simple design, rocker mechanisms are mostly clearly cheaper to produce than the previously described mechanisms.

Common to all said mechanisms is that a pivoting movement of individual or multiple mechanism components is possible in the longitudinal direction of the chair, i.e. forward or backward.

BRIEF SUMMARY OF THE INVENTION

An object of the present invention is to improve the sitting comfort of chair mechanisms.

Said object is achieved by a mechanism as claimed or by a chair as claimed. Advantageous realizations of the invention are provided in the dependent claims.

The advantages and developments explained below in conjunction with the chair mechanism also apply analogously to the chair according to the invention and vice versa.

The chair mechanism according to the invention includes a base support which is placeable on a chair column, a seat support which is arranged on the base support and a backrest support which is connected to the seat support and is characterized in that, the seat support includes a first seat support element and a second seat support element, wherein the second seat support element is movable transversely with respect to the longitudinal direction of the chair relative to the first seat support element and/or the backrest support includes a first backrest support element and a second backrest support element, wherein the second backrest support element is rotatable relative to the first backrest support element about a rotational axis which lies in the longitudinal direction of the chair.

A chair mechanism with improved sitting comfort is created with the invention.

A core idea of the invention, as an alternative to or in addition to the above-described forward and rearward pivoting movement, is to enable a tilting movement of individual or multiple mechanism components to the right and to the left.

In embodiments of the invention a two-part seat support is provided for this purpose. In other embodiments of the invention, a two-part backrest support is additionally provided and the desired transverse movement of the seat support is transmitted via suitable means to the backrest support or vice versa.

In an advantageous manner, the movements of the individual mechanism components can be carried out independently of one another. This means, for example, that a tilting movement of a seat support component, when viewed in the longitudinal direction of the chair, is possible to the right or left independently of a forward or rearward pivoting movement of the seat support. This is achieved as a result of the number of degrees of freedom available being increased compared to a conventional chair mechanism. The movement behavior of the chair with respect to movements of the user is improved when compared to conventional solutions.

BRIEF DESCRIPTION OF THE SEVERAL VIEWS OF THE DRAWING

Exemplary embodiments of the invention are explained in more detail below by way of the drawings, in which.

DESCRIPTION OF THE INVENTION

None of the figures show the invention true to scale, in this case they are purely schematic and are only provided with their essential component parts. Identical reference signs correspond in this case to elements of identical or comparable function.

Figure 1:
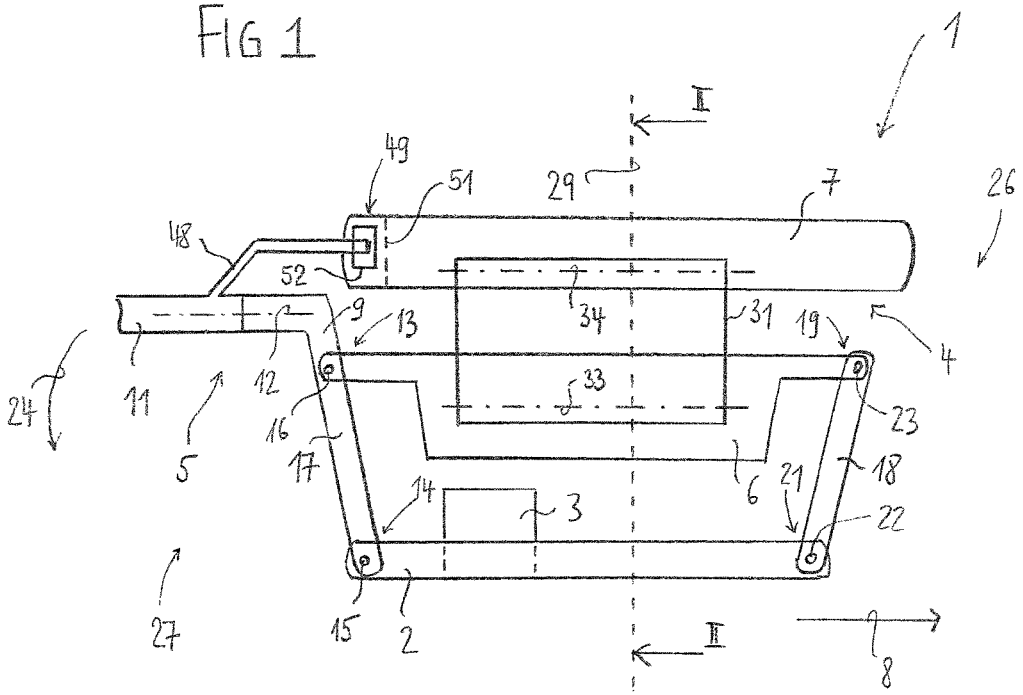
FIGS. 1-15 show representations of a first exemplary embodiment.
Figure 2:
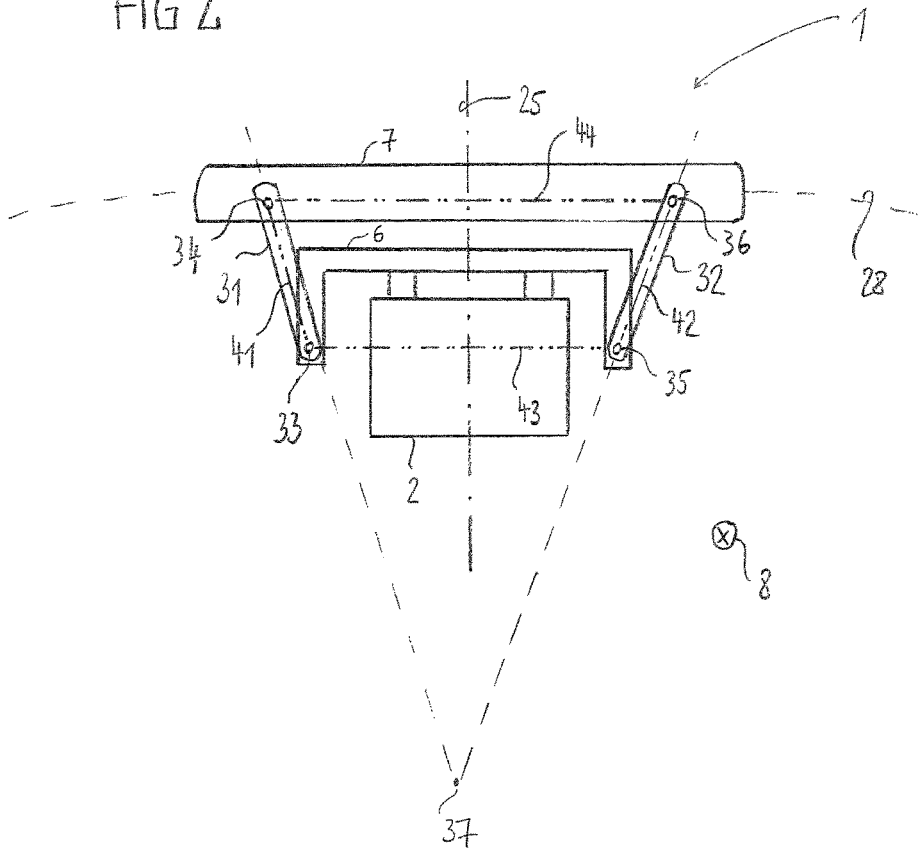
Figure 3:
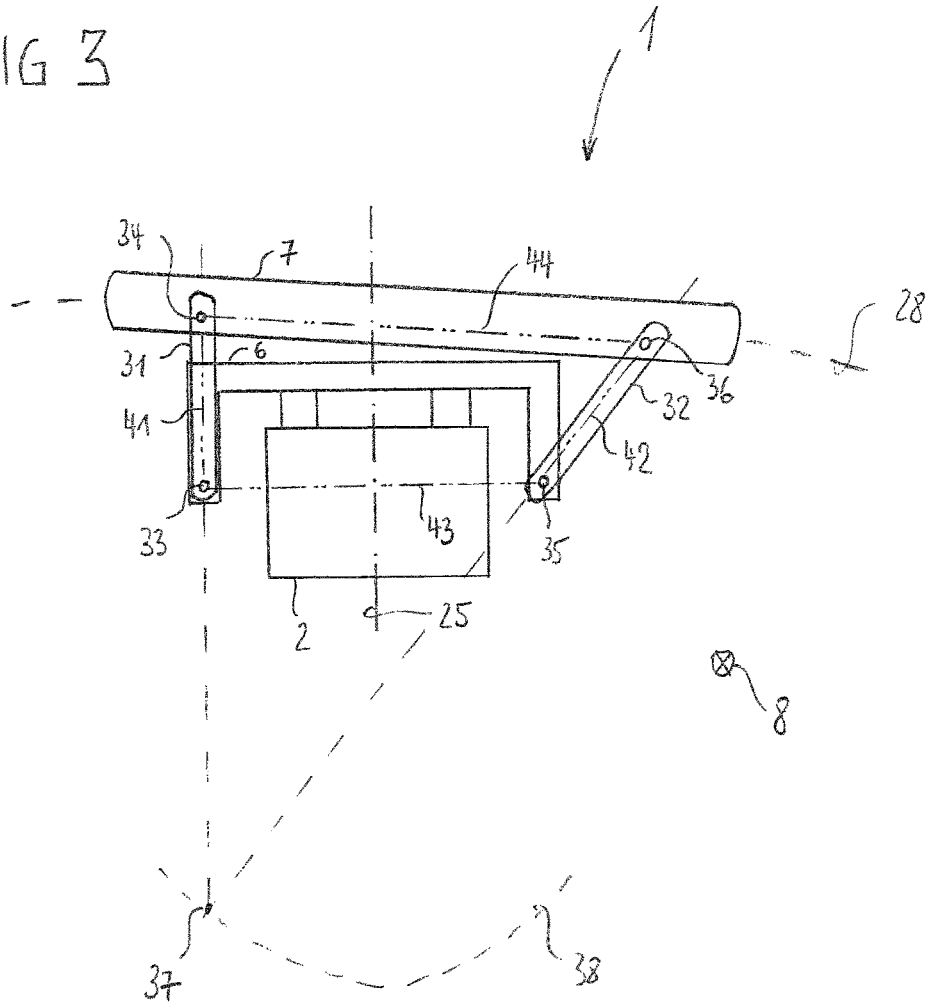
Figure 4:
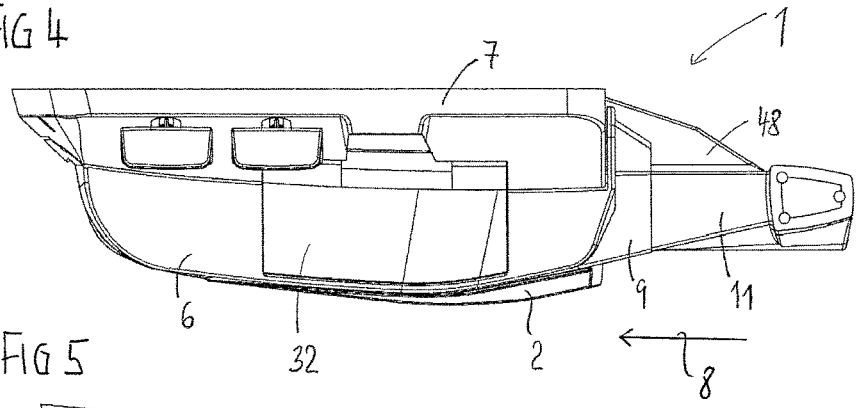

FIG. 1 shows a side view of a mechanism 1 for an office chair, in the non-pivoted and non-tilted state. FIG. 2 shows the mechanism 1 from FIG. 1 in a cross section along the line II-II. FIG. 3 shows the mechanism 1 from FIG. 2 with a seat support element that is tilted sideways.

The mechanism 1 comprises a base support 2 which is placed onto the upper end of a chair column (not shown) by means of a tapered receiving means 3. The mechanism 1 includes a seat support 4 which is arranged on the base support 2 and is movable forward and rearward in the longitudinal direction 8 of the chair relative to the fixed base support 2. The seat (not shown) of the office chair, which is generally speaking provided with an upholstered sitting surface, is mounted on the seat support 4.

The seat support 4 includes a first seat support element 6 and a second seat support element 7, wherein the second seat support element 7 is movable transversely with respect to the longitudinal direction 8 of the chair, i.e. to the right and left, relative to the first seat support element 6. The first seat support element 6 is the seat support base which is attached separately from the actual seat, an element of the seat support 4 which interacts with the base support 2. The second seat support element 7 is the seat mounting element which either includes the seat with the sitting surface or, however,—for example realized as a mounting plate—provides the prerequisites necessary for mounting a seat.

The mechanism 1 additionally includes a backrest support 5 which is connected to the seat support 4 and the base support 2. The backrest (not shown) of the office chair, which is generally speaking provided with an upholstered leaning surface, is connected to the backrest support 5.

The backrest support 5 includes a first backrest support element 9 and a second backrest support element 11, the second backrest support element 11 being rotatable (tiltable) about a rotational axis 12 (tilt axis) which lies in the longitudinal direction 8 of the chair relative to the first backrest support element 8. The first backrest support element 9 is the backrest support base, an element of the backrest support 5 which interacts with the base support. The second backrest support element 11 is the backrest mounting element which either includes the backrest with a leaning surface or, however,—for example realized as a mounting adapter—provides the prerequisites necessary for mounting a backrest.

The backrest support 5 is connected both to the, when viewed in the longitudinal direction 8 of the chair, rear end 13 of the first seat support element 6 and to the rear end 14 of the base support 2 so as to pivot about rear rotational axes 15, 16 which extend transversely with respect to the longitudinal direction 8 of the chair, the connecting region of the backrest support 5 between said two rotational axes 15, 16 serving as rear coupling element 17 between base support 2 and seat support 4. A front coupling element 18 is connected both to the, when viewed in the longitudinal direction 8 of the chair, front end 21 of the base support 2 and to the front end 19 of the first seat support element 6 so as to be pivotable about front rotational axes 22, 23 which extend transversely with respect to the longitudinal direction 8 of the chair.

Figure 5:
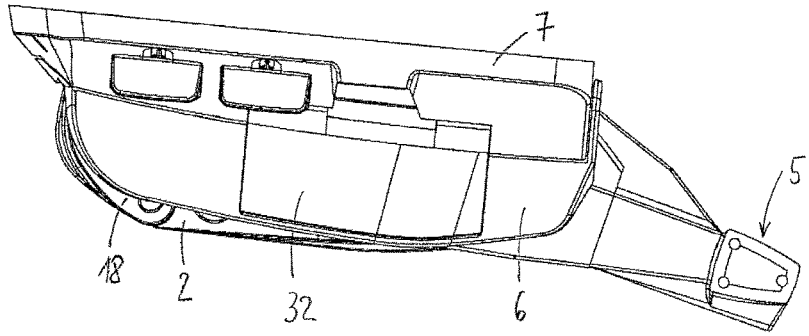

On account of the described connection between the backrest support 5 and the seat support 4, pivoting of the backrest support 5 to the rear in the pivoting direction 24, i.e. from an upright starting position (FIG. 1, 2, 4, 8, 12) into a rear pivot position (FIG. 5, 9, 13) of the mechanism 1, results in a movement of the entire seat support 4 relative to the fixed base support 2, the seat support 4 in the example described here being lowered at the back and raised at the front.

The manner of the coupling of the pivotable backrest support 5 to the first seat support element 6 and/or the base support 2 is not important to the present invention. This can be, in this case, a direct or an indirect coupling. The same applies to the linking of the backrest support 5 to the base support 2 and the seat support 4 and consequently to the specific development of the synchronous movement between backrest and seat.

The mechanism 1 is designed in a mirror-symmetrical manner with reference to the center longitudinal plane 25 (see FIG. 2), as regards the actual kinematics. In this respect, this description always assumes construction elements of the mechanism 1 to be present in pairs on both sides. Parts of the mechanism 1, in particular parts of the base support 2, are not shown in FIGS. 2 and 3 for reasons of clarity.

The terms "pivoting movement, pivot, pivot axis" etc. refer to the movement of the backrest support 5 and of the seat support 4 about rotational axes 15, 16, 22, 23 which extend transversely with respect to the longitudinal direction 8 of the chair when the backrest support 5 is pivoted. The terms "tilting movement, tilt, tilt axis" etc. refer to the movement of the second seat support element 7 or of the second backrest support element 11 about rotational axes 12, 33, 34, 35, 36 which extend in the longitudinal direction 8 of the chair, the tilting movement being able to include a rotational and translational proportion. The term "tipping" relates to the rotational proportion of the tilting movement. The longitudinal direction 8 of the chair extends from the front side 26 of the chair in the direction of the rear side 27 of the chair.

It is advantageous when the two seat support elements 6, 7 are arranged one above another, in particular such that the second seat support element 7 is arranged on the first seat support element 6 or is arranged above the first seat support element 6 or is supported by the first seat support element 6. In said cases, the transverse movement system according to the invention can be used with an already existing chair mechanism without great structural adaptations. For example, a second seat support element 7 can be fitted onto an existing mechanism component as an additional component, the seat support of the conventional mechanism forming the first seat support component 6 of the mechanism 1 according to the invention.

The first seat support element 6 can be realized as a mechanism component which is pivotally mounted on the base support 2 or the backrest support 5 in a proven manner by means of axes 22, 15 which extend transversely with respect to the longitudinal direction 8 of the chair. The first seat support element 6 can, however, also be realized as a seat carriage which is displaceable in the longitudinal direction 8 of the chair; in said case, it can be suitable, for example, for seat depth adjustment.

It has proven particularly advantageous for the second seat support element 7 to be movable relative to the first seat support element 6 along a track curve 28 which lies in a plane 29 transversely with respect to the longitudinal direction 8 of the chair, said plane 29 preferably being a vertical plane (see FIG. 1). The plane 29 can, however, also lie at an angle to the vertical.

Over and above this, it is particularly advantageous when the seat supported by the second seat support element 7 tilts to the side, when viewed in the longitudinal direction 8 of the chair, when the second seat support element 7 is moved relative to the first seat support element 6. The specific realization of the seat, in this case, is not important to the invention.

The tilting movement of the second seat support element 7 preferably includes, in this case, a translation and a rotation. In other words, a sideways movement, that is to say a movement of the second seat support element 7 transversely with respect to the longitudinal direction 8 of the chair, is combined with a tipping or tilting movement of the second seat support element 7 relative to the first seat support element 6. An exclusive rotation of the second seat support element 7, i.e. a pure tipping movement, is effected as an alternative to this, but is not preferable, see FIG. 18.

In the first embodiment (FIGS. 1 to 15) the second seat support element 7 is connected to the first seat support element 6 by means of at least one controller arrangement. In this case, the controller arrangement includes two controllers 31, 32 (coupling elements), one of which in each case being provided on each side of the vertical center longitudinal plane 25 of the chair. In this case, each controller 31, 32 is pivotably mounted both on the first seat support element 6 so as to be rotatable about a first rotational axis 33, 35 and on the second seat support element 7 so as to be rotatable about a second rotational axis 34, 36, wherein all rotational axes 33, 34, 35, 36 are parallel with one another and extend in the longitudinal direction 8 of the chair. At the same time, all the rotational axes 33, 34, 35, 36 extend below the sitting surface of the seat.

Realized in such a manner, the connection between the two seat support elements 6, 7 together is effected realizing a four-bar linkage, a virtual fulcrum 37 (instantaneous center of rotation) being produced for the second seat support element 7 as a point of intersection between the two straight lines which extend through the controllers 31, 32 (more precisely the hinging points thereof). As a result of the length of the controllers 31, 32 and/or the position of the hinging points or rotational axes 33, 34, 35, 36 on the first and second seat support elements 6, 7, the distance between the instantaneous center of rotation 37 and the seat support 4 can be defined depending on the desired movement/tilting dynamic of the seat.

The controllers 31, 32 are realized in the illustrated example as plate-shaped coupling elements, the pivot joints for coupling to the first and second seat support elements 6, 7 being provided on the lower and upper side edges of the controllers 31, 32 such that the rotational axes 33, 43, 35, 36 extend parallel to the longitudinal direction of the controllers 31, 32. The number of controllers 31, 32 on each side of the center longitudinal plane 25 can also be greater. Thus, it is possible, for example, depending on the structural realization, for two or three controllers to be provided per side instead of one single controller 31, 32 per side.

The instantaneous center of rotation 37 is preferably situated below the seat support 4, more precisely below the sitting surface of the seat. In the case of the variant illustrated in FIG. 18, the instantaneous center of rotation 37 is situated in a fixed manner as a real pivot point in the seat support 4. No translation takes place, just a tipping movement.

It has proved to be particularly advantageous when the instantaneous center of rotation 37 of the seat support 4 is always situated so far removed from the seat support 4 when the second seat support element 7 is moved transversely with respect to the longitudinal direction 8 of the chair that the translation proportions of the movement are greater than the rotation proportions. The instantaneous center of rotation 37 is preferably additionally situated so far removed from the seat support 4 that the translation components of the movement of the second seat support element 7 is greater than the rotation/tilting component of the movement. In other words, the second seat support element 7 is not moved along an extremely curved or steep trajectory but rather along a rather flat trajectory instead. This benefits increased sitting comfort. The instantaneous center of rotation 37 is preferably situated close to the ground, that is to say in the vicinity of the chair support provided at the lower end of the chair column (not shown).

Figure 18:
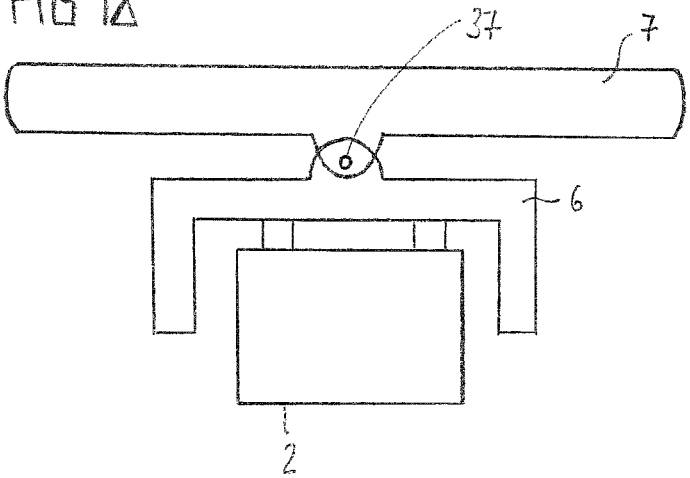
FIG. 18 shows a representation of a fourth exemplary embodiment.

When the seat support 4 tilts when using the controller arrangement 31, 32 (four-bar linkage), the instantaneous center of rotation 37 also moves, as shown in FIGS. 2 and 3, along a trajectory 38 (see FIG. 3) and is not fixed. This is perceived as particularly pleasant for the movement dynamics. In the case of a pure tipping movement, as shown in FIG. 18, the instantaneous center of rotation 37 is positionally fixed.

The pivot points of the two controllers 31, 32, defined by the position of the axes 33, 34, 35, 36, form (viewed in the longitudinal direction 8 of the chair) in the non-deflected state a symmetrical, in particular isosceles trapezium. In this case, the two controllers 31, 32, more precisely the connecting lines 41, 42 between the upper and lower pivot points (axis locations), form the trapezium legs, the connecting line 43 between the upper pivot points forms the upper trapezium bottom side and the connecting line 44 between the lower pivot points forms the lower trapezium bottom side.

On account of the position of the controllers 31, 32 to achieve an instantaneous center of rotation 37 arranged below the seat support 4, the upper bottom side of the trapezium is longer than the lower bottom side. In other words, the distance between the lower axes, that is to say the axes 33, 35 of the joints of the connection between the controllers 31, 32 and the first (lower) seat support element 6, is smaller than the distance between the upper axes, that is to say the axes 34, 36 of the joints of the connection between the controllers 31, 32, and the second (upper) seat support element 7. For this reason, this is an unstable system which tends to tip. Consequently, a number of spring elements (not shown) is provided which—cooperating at suitable points—hold the second seat support element 7 in the non-tilted basic state in position with respect to the first seat support element 6 and in the tilted state, support or bring about restoring the second seat support element 7 into the basic position thereof. In particular, spring elements are provided which, on the one hand, are connected to the first seat support element 6 and, on the other hand, to the second seat support element 7 or to the controllers 31, 32 in order to hold the second seat support element 7 in its basic position which is not tilted to the right or the left.

Figure 16:
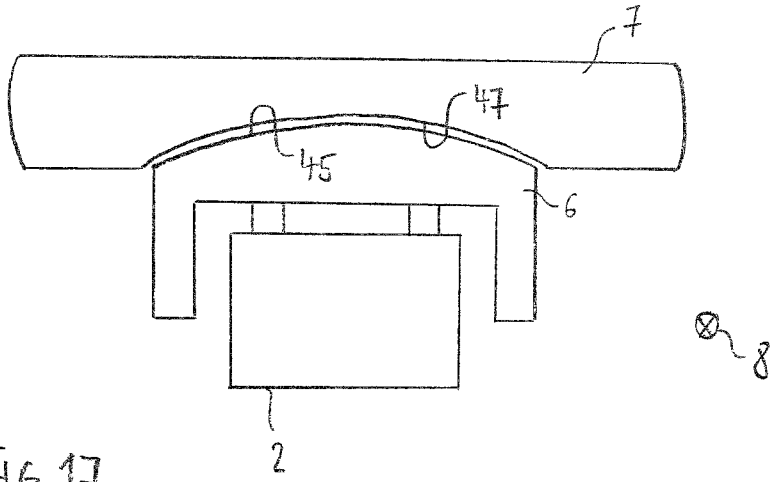
FIG. 16 shows a representation of a second embodiment.
Figure 17:
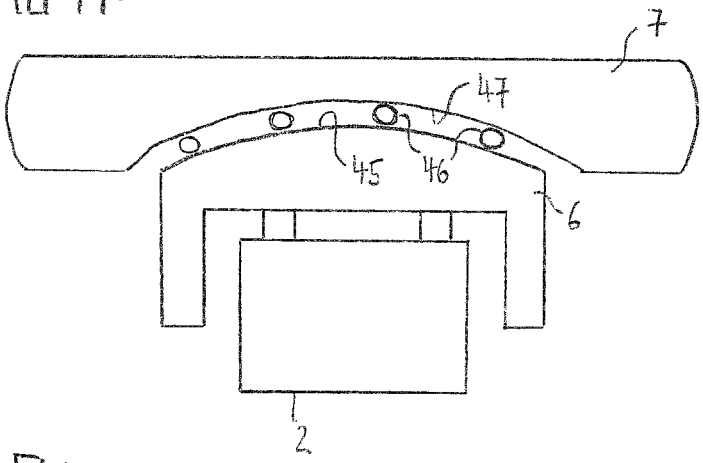
FIG. 17 shows a representation of a third exemplary embodiment.

Other types of connection between the two seat support elements 6, 7 are provided in further embodiments. In a second and third embodiment (FIGS. 16 and 17), the second seat support element 7 is connected to the first seat support element 6 by the second seat support element 7 resting in a sliding (FIG. 16) or rolling (FIG. 17) manner, directly or indirectly, e.g. by means of ball bearings 46 or the like, on a surface 45 of the first seat support element 6 which defines the movement path of the second seat support element 7. The form of the surface 45, in this case, defines the movement path of the second seat support element 7 transversely with respect to the longitudinal direction 8 of the chair. Even when using such a rolling or sliding track, a wandering instantaneous center of rotation 37 can also be achieved as a result of the design of the surface 45 of the rolling or sliding track. A surface 45 of the first seat support element 6, which is convexly arched in the direction of the second seat support element 7 preferably interacts, in this case, with a surface 47 of the second seat support element 7 which is concavely arched in the direction of the first seat support element 6.

It is, however, possible not only to realize the first and the second seat support elements 6, 7 as two components which are separate from one another and are connected together mechanically, e.g. by means of the described coupling elements (controllers 31, 32). As an alternative to this, at least one elastic coupling element (not shown) can be arranged between the first and the second seat support elements 6, 7 as a third component, for example in the form of a cuboid or cylindrical buffer element which ensures the required mobility of the two seat support elements 6, 7 with respect to one another. In this case, the buffer element is designed, for example, in such a manner that a rubber-elastic material is arranged between a base plate and a cover plate. Such or similar buffer elements can also be provided between the mechanism components 6, 7 etc. which are movable with respect to one another, as stop elements for delimiting movement.

As an alternative to a multi-part design of the seat support 6, 7 (with or without buffer elements), a one-part realization of the two seat support elements 6, 7 is also possible, preferably using suitable flexible or elastic connecting material which allows for a transverse movement and/or tilting of the second seat support element 7 relative to the first seat support element 6. Such a variant can be produced in a particularly advantageous manner, for example using a multi-component injection molding method with diverse suitable plastics materials. The mechanism components, in this case, are preferably designed in a resilient manner, i.e. realized in particular for returning the moving or deflected element back into the basic position. The spring elements otherwise necessary for aligning the second seat support element 7 or for retaining the state of equilibrium of the second seat support element 7 in the unoccupied state can then be omitted.

In the variant illustrated in FIGS. 1 to 15, the movement of the second backrest support element 11 includes exclusively a rotation. The central rotational axis 12 (tilt axis) necessary for rotating the backrest support element 11 preferably extends, in this case, below the sitting surface of the seat. In the example shown, the rotational axis 12 of the backrest support 5 extends in the longitudinal direction 8 of the chair and parallel to the rotational axes 33, 34, 35, 36 of the controller arrangement 31, 32, and consequently perpendicular to the rotational axis 15, 16, 22, 23 of base support 2, seat support 4 and backrest support 5. In addition, the rotational axis 12 is arranged in the vertical direction between the first rotational axes 33, 35 of the controllers 31, 32 and the second rotational axes 34, 36 of the controllers 31, 32.

The first and the second backrest support elements 9, 11 are preferably realized as two components which are separate from one another and are connected together mechanically, e.g. by means of a face-side connection with a rotational degree of freedom. As an alternative to this, however, a one-part realization of the two backrest supports 9, 11 is also possible, preferably using suitable flexible or elastic connecting material which allows the second backrest support element 11 to rotate about the rotational axis 12.

The second backrest support element 11 is preferably realized as a central support arm which extends centrally to the rear away from the chair mechanism 1. As an alternative to this, the second backrest support element 11 is realized as part of a frame 50 for the backrest, for example as a central connecting element between the backrest support 5 and a lower cross strut of the frame 50.

The second backrest support element 11 is preferably coupled with the second seat support element 7 in such a manner that a movement of the second seat support element 7 relative to the first seat support element 6 brings about a movement of the second backrest support element 11 relative to the first backrest support element 9 (or vice versa), more precisely brings about a tilt of the second backrest support element 11 to the right or the left. In other words, an advantageous combination of the two tilting movements takes place. Not only the seat tilts (to the right or left), but also the backrest. A fixed backrest with a tilting seat would be less comfortable. The lateral tilting of the seat or of the backrest (without the seat support 4 being pivoted to the rear by the backrest support 5) is shown in FIGS. 3, 6, 10, 14.

The tilting movement of the backrest support 5, more precisely the tilting movement of the second backrest support element 11 and consequently of the backrest, is induced solely and exclusively as a result of the pivotable mounting of the second backrest support element 11 on the second seat support element 7.

When the second seat support element 7 is moved relative to the first seat support element 6, the backrest, which is supported by the second backrest support element 11, preferably tilts to the side when seen in the longitudinal direction 8 of the chair. The specific realization of the backrest, in this case, is insignificant to the invention.

In the case of the variant shown in FIGS. 1 to 15, the second backrest support element 11 is connected to the second seat support element 7 by a connecting arm 48 of the second backrest support element 11 engaging with its free end 49 in a receiving opening 51 of the second seat support element 7 or being inserted in such a receiving opening 51. The introduction of force or the transmission of torque from the second seat support element 7 to the second backrest support element 11 is effected exclusively via the connecting arm 48.

The connecting arm 48, in this case, is preferably not realized in a non-rotatable manner, i.e. the free end 49 is inserted so as to be rotatable in the receiving opening 51. The free end 49, in this case, is displaceable in the receiving opening 51 both axially, i.e. in the longitudinal direction 8 of the chair, and vertically such that the connecting arm 48—corresponding to the combined translational/rotational movement of the second seat support element 7 along the defined trajectory 28 relative to the first seat support element 6—can be entrained with limited degrees of freedom in such a manner that it brings about a (pure) rotational movement of the second backrest support element 11 about the rotational axis 12 thereof relative to the first backrest support element 9.

Said coupling is realized, for example, by a sliding block 52 or the like which is attached on the free end 49 of the connecting arm 48 and is inserted in the link or receiving opening 51 of the second seat support element 7, which is realized in the manner of a groove, (abutting there against the vertical side surfaces of the groove). In this case, the movement of the link and consequently the movement of the second seat support element 7 is transmitted to the forcibly actuated sliding block 52, the rotational degree of freedom being realized by a suitable rotary connection between the sliding block 52 and the connecting arm 48.

The dividing of the backrest support 5 into two parts is effected, in this case, such that the first backrest support element 9 as the, when viewed in the longitudinal direction 8 of the chair, front part of the backrest support 5, realizes the connection of the backrest on the base support 2 and the first seat support element 6, whilst the second backrest support element 11, which, when viewed in the longitudinal direction 8 of the chair, connects toward the rear to the first backrest support element 9, forms the transition to the backrest, but is at the same time coupled to the second seat support 7.

As an alternative to this, the connection or coupling of the second seat support element 7 to the second backrest support element 11 is effected by means of a number of controllers (not shown) which are pivotably connected to the second seat support element 7 and to the second backrest support element 11 and are preferably realized, as the controllers between the two seat support elements 6, 7, in the manner of a four-bar linkage, or, however, by means of other coupling elements. As an alternative to this, the connection or coupling of the second seat support element 7 to the second backrest support element 11 is effected by means of a one-part realization of seat support element 7 and backrest support element 11 using a suitable flexible or elastic material.

Figure 6:
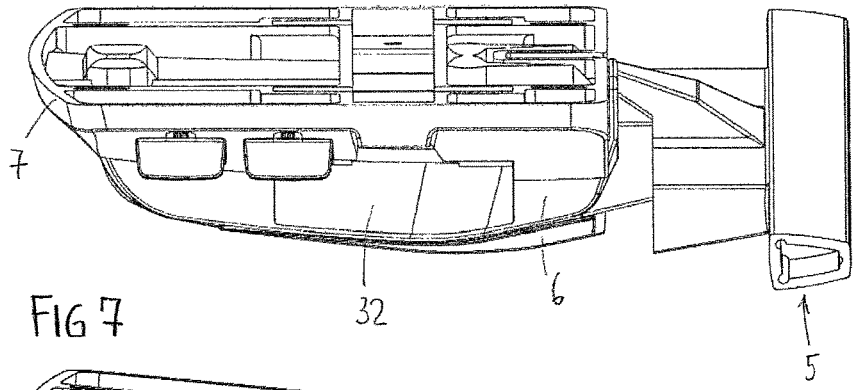
Figure 10:
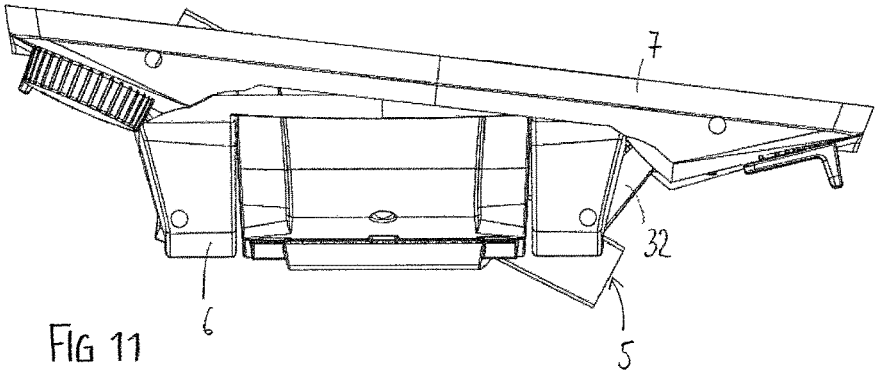
Figure 14:
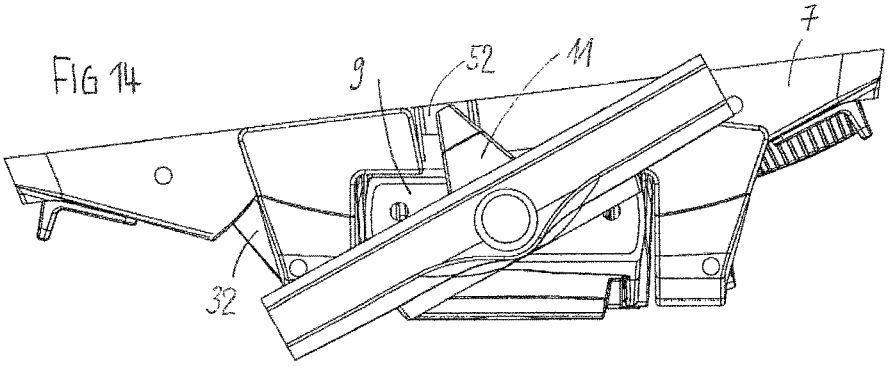

One variant has proven to be particularly advantageous where the tilting of the backrest or of the second backrest support element 11 differs from the tilting of the seat or of the second seat support element 7. With the invention it is therefore possible not only to realize a tilting movement of the second seat support element 7 to the right or left exclusively without this resulting in a following movement of the backrest support 5; the coupling of the backrest support 5 to the second seat support element 7 has simply to be omitted for this purpose. The tilting movements of the participating elements can also deviate from one another. In the simplest case, the tilting of the second backrest support element 11, and consequently of the backrest, certainly corresponds to the tilting of the second seat support element 7 and consequently of the seat. The backrest preferably moves, however, at a ratio that deviates from the tilting seat, i.e. the two tilt angles are not the same. An unequal amount of tilt has proved to be particularly user-friendly, in particular whenever a tilt of the second seat support element 7 about a certain tilt angle is followed by a tilt of the second backrest support element 11 by a larger tilt angle, as shown in FIGS. 6, 10 and 14.

The position of the rotational axis 12 of the backrest support 5 is preferably situated below the connecting point of the free end 49 of the connecting arm 48 to the seat support 4, that is to say below the point at which the sliding block 52 is inserted in the receiving opening 51. The achievement here is that the backrest tilts in the same direction as the seat. The backrest being pivoted in the contrary direction (pivoting in the opposite direction) can be achieved correspondingly as a result of a reverse arrangement of said two points with respect to one another.

The further the instantaneous center of rotation 37 of the second seat support element 7 is from the stationary rotational axis 12 of the backrest support 5, the greater the deviation of the tilt movement of the second backrest support element 11 to that of the second seat support element 7. The desired tilt ratio between seat and backrest can consequently be adjusted, in particular as a result of the structural arrangement of the position of the axes 33, 34, 35, 36, as a result of the defined adjustment of the distances between axes 33, 34, 35, 36 with respect to one another and/or as a result of the arrangement of the real and virtual pivot points 37 of the participating components of the chair mechanism 1.

One variant of the invention ranks as particularly advantageous where the backrest support 5, more precisely the first backrest support element 9, is coupled with the seat support 4, more precisely with the first seat support element 6, in such a manner that pivoting of the backrest support 5 in the longitudinal direction 8 of the chair brings about a movement of the seat support 4 in the longitudinal direction 8 of the chair about a pivot axis, which extends transversely with respect to the longitudinal direction 8 of the chair, relative to the base support 2 ("synchronous mechanism"). It is possible, however, to realize other types of mechanisms, such as asynchronous mechanisms, rocker mechanisms or mixed types, from the chair mechanism 1 which is provided with the invention, in place of such a classic synchronous mechanism.

In this case, the (tilt) movement of the second seat support element 7 relative to the first seat support element 6 is independent of any other movement of the seat support 4 in the longitudinal direction 8 of the chair, in particular independent of the (pivot) movement of the seat support 4 which is brought about by the backrest support 5. Said structural and functional independence of the movements is achieved as a result of separating the seat support 4 into two seat support elements 6, 7. Both movements are possible independently of one another, i.e. not coupled together, also overlapping one another. For example, independently of a tilting movement of the second seat support element 7 to the right or left, the entire seat support 4 is entrained when the backrest support 5 is pivoted to the rear and a tilting movement of the second seat support element 7 to the right and left can be effected in the non-pivoted state of the mechanism 1 or, however, also in addition to a pivoting of the backrest.

Figure 7:
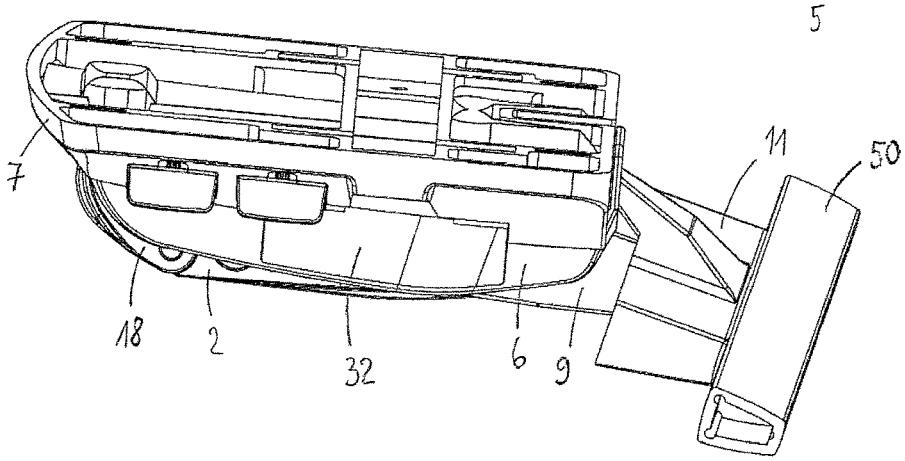
Figure 8:
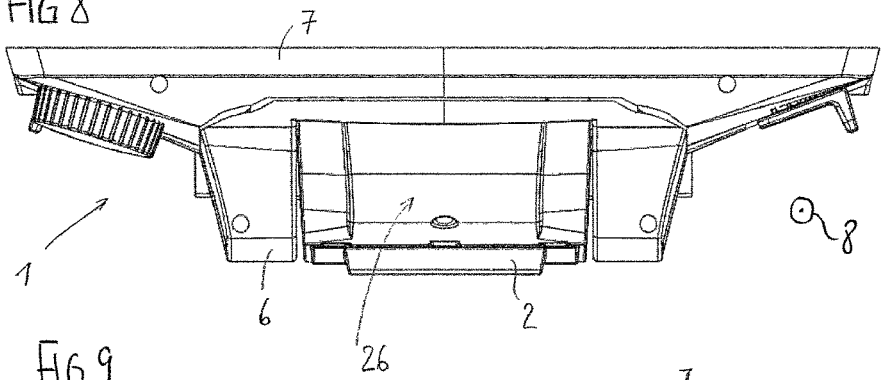
Figure 9:
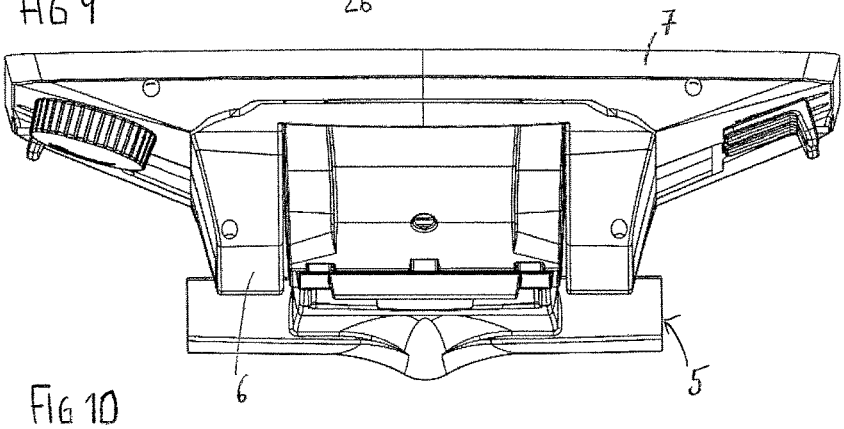
Figure 11:
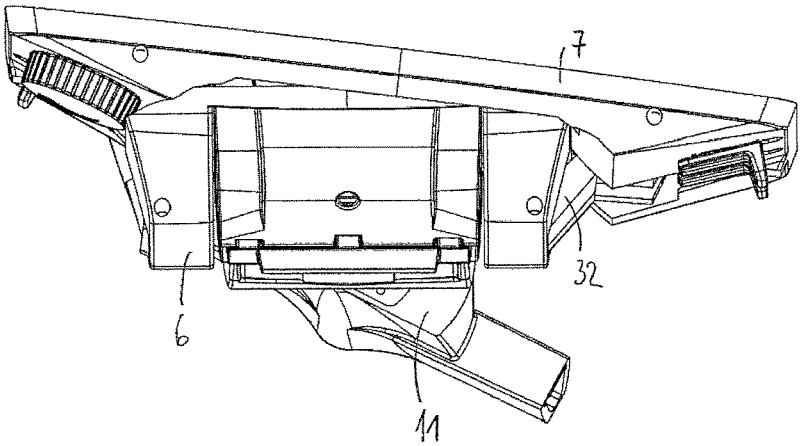
Figure 12:
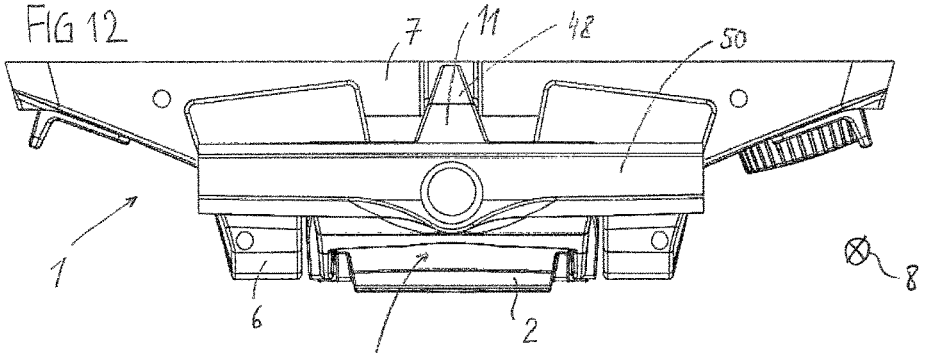
Figure 13:
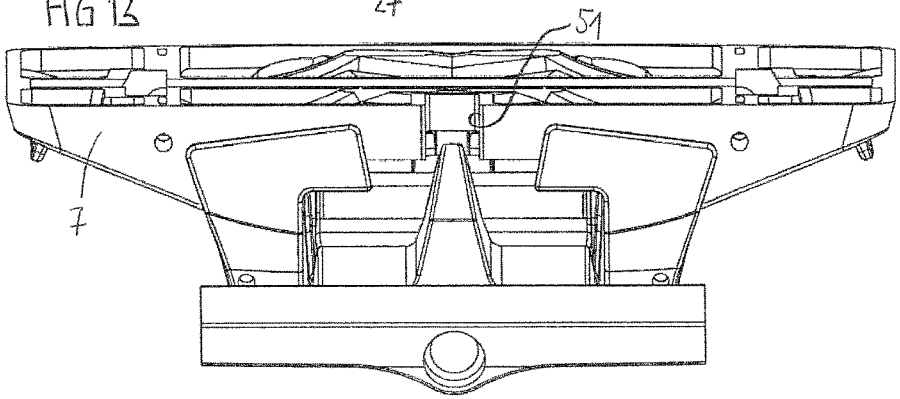
Figure 15:
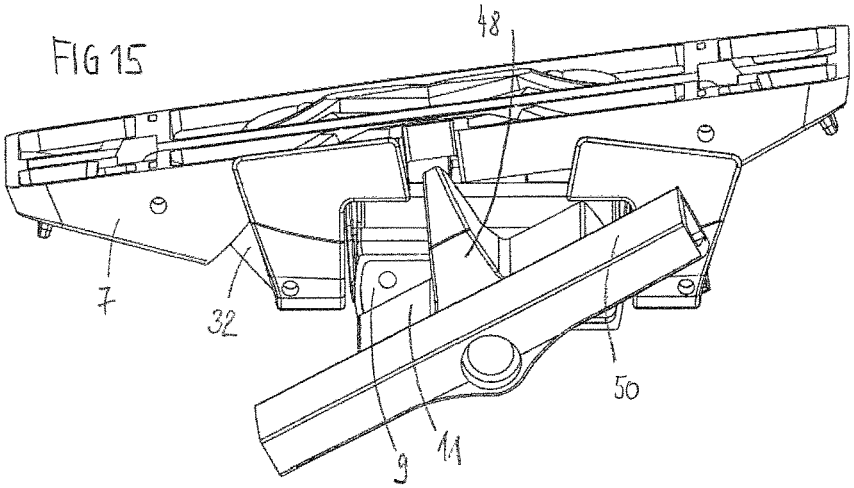

This is illustrated as an example in FIGS. 4 to 15 by way of the first exemplary embodiment. Here, FIGS. 4 to 7 show a side view of the mechanism, namely in the starting position (FIG. 4), pivoted to the rear (FIG. 5), with seat and backrest tilted to the side (FIG. 6) and in a position that is both tilted and pivoted (FIG. 7). FIGS. 8 to 11 show the mechanism from the front, namely in the starting position (FIG. 8), pivoted to the rear (FIG. 9), with seat and backrest tilted to the side (FIG. 10) and in a position that is both tilted and pivoted (FIG. 11). FIGS. 12 to 15 show the mechanism from the rear, namely in the starting position (FIG. 12), pivoted to the rear (FIG. 13), with seat and backrest tilted to the side (FIG. 14) and in a position that is both tilted and pivoted (FIG. 15).

The number of degrees of freedom is increased with the invention compared to a conventional chair mechanism by further degrees of freedom being provided for the seat support 4 and as an option also for the backrest 5. The movement behavior of the chair with respect to the movements of the user is improved compared to conventional solutions.

All the features shown in the description, the following claims and the drawing can be essential to the invention both on their own and also together in arbitrary combination.

LIST OF REFERENCES

1 Mechanism
2 Base support
3 Tapered receiving means
4 Seat support
5 Backrest support
6 First seat support element
7 Second seat support element

8 Longitudinal direction of the chair
9 First backrest support element
10 (Free)
11 Second backrest support element
12 Rotational axis of the backrest support
13 Rear end of the first seat support element
14 Rear end of the base support
15 Rear rotational axis
16 Rear rotational axis
17 Rear coupling element
18 Front coupling element
19 Front end of the first seat support element
20 (Free)
21 Front end of the base support
22 Front rotational axis
23 Front rotational axis
24 Pivot direction
25 Center longitudinal plane
26 Chair front side
27 Chair rear side
28 Trajectory
29 Plane of the trajectory
30 (Free)
31 First controller
32 Second controller
33 First rotational axis of the first controller
34 Second rotational axis of the first controller
35 First rotational axis of the second controller
36 Second rotational axis of the second controller
37 Virtual fulcrum, instantaneous center of rotation
38 Trajectory of the instantaneous center of rotation
39 (Free)
40 (Free)
41 Vertical connecting line
42 Vertical connecting line
43 Horizontal connecting line
44 Horizontal connecting line
45 Surface of the first seat support element, rolling/sliding track
46 Ball bearing
47 Surface of the second seat support element
48 Connecting arm
49 Free end
50 Frame
51 Receiving opening
52 Sliding block

The invention claimed is:

1. A mechanism for a chair, comprising:

a base support to be placed on a chair column;

a seat support disposed on said base support and movable in a longitudinal direction of the chair relative to said base support;

a backrest support connected to said seat support;

wherein one or both of the following is true:

said seat support including a first seat support element and a second seat support element, said second seat support element being mounted for a translation and a rotation and being movable transversely with respect to the longitudinal direction of the chair relative to said first seat support element; or said backrest support including a first backrest support element and a second backrest support element, said second backrest support element being rotatably mounted relative to said first backrest support element about a rotational axis extending in the longitudinal direction of the chair;

at least one controller arrangement connecting said second seat support element to said first seat support element, said controller arrangement including two controllers each being pivotally mounted both on said first seat support element so as to be rotatable about a first rotational axis and on said second seat support element so as to be rotatable about a second rotational axis, wherein said rotational axes are parallel with one another and extend in the longitudinal direction of the chair.

2. The mechanism according to claim 1, wherein, when said second seat support element is moved relative to said first seat support element, a seat that is supported by said second seat support element, when viewed in the longitudinal direction of the chair, tilts sideways.

3. The mechanism according to claim 1, wherein an instantaneous center of rotation of said second seat support element, when said second seat support element is moved transversely with respect to the longitudinal direction of the chair, is always situated so far removed from said seat support that translation proportions of a movement are greater than rotation proportions of the movement.

4. The mechanism according to claim 1, wherein said second seat support element is disposed to rest on a surface of said first seat support element.

5. The mechanism according to claim 1, wherein said second backrest support element is coupled with said second seat support element such that a movement of said second seat support element relative to said first seat support element brings about a movement of said second backrest support element relative to said first backrest support element.

6. The mechanism according to claim 1, wherein, when said second seat support element moves relative to said first seat support element, said backrest supported by said second backrest support element, when viewed in the longitudinal direction of the chair, tilts sideways.

7. The mechanism according to claim 1, wherein said second backrest support element is connected to said second seat support element by a connecting arm of said second backrest support element engaging in a receiving opening of said second seat support element.

8. The mechanism according to claim 1, wherein said backrest support is coupled with said seat support such that a pivoting of said backrest support brings about a movement of said seat support in the longitudinal direction of the chair relative to said base support.

9. The mechanism according to claim 8, wherein a movement of said second seat support element relative to said first seat support element is independent of a movement of said seat support brought about by said backrest support.

10. A chair, comprising a mechanism according to claim 1.

11. The chair according to claim 10, configured as an office chair.

* * * * *